United States Patent [19]

Aiba

[11] Patent Number: 4,567,353

[45] Date of Patent: Jan. 28, 1986

[54] HIGH-ACCURACY TEMPERATURE CONTROL

[75] Inventor: Masahiko Aiba, Nara, Japan

[73] Assignee: Sharp Kabushiki Kaisha, Osaka, Japan

[21] Appl. No.: 634,674

[22] Filed: Jul. 30, 1984

Related U.S. Application Data

[63] Continuation of Ser. No. 130,998, Mar. 17, 1980, abandoned, which is a continuation of Ser. No. 893,791, Apr. 5, 1978, abandoned.

[30] Foreign Application Priority Data

Apr. 7, 1977 [JP] Japan ..... 52-40086

[51] Int. Cl.[4] ..... H05B 1/02

[52] U.S. Cl. ..... 219/501; 219/497; 219/508; 222/146.5; 237/2 A

[58] Field of Search ..... 219/494, 497, 499, 505, 219/501, 506, 508, 321, 216, 212; 323/75 N, 22 SC, 263; 222/146 HE; 236/2, 15 A; 237/2 A

[56] References Cited

U.S. PATENT DOCUMENTS

| | | | |
|---|---|---|---|
| 3,114,025 | 12/1963 | Blauvelt et al. | 219/494 |
| 3,254,838 | 6/1966 | Chambers | 219/499 X |
| 3,308,271 | 3/1967 | Hilbiber | 219/501 |
| 3,393,870 | 7/1968 | Jeffrey | 219/501 X |
| 3,509,322 | 4/1970 | Lundin | 219/492 X |
| 3,633,094 | 1/1972 | Clements | 219/497 |
| 3,745,308 | 7/1973 | Lefferts | 219/501 |
| 3,789,190 | 1/1974 | Orosy et al. | 219/501 |
| 3,959,692 | 5/1976 | Wetzel | 219/499 |
| 3,999,190 | 12/1976 | Brown et al. | 219/501 |
| 4,021,722 | 5/1977 | Crowle | 219/501 |

*Primary Examiner*—M. H. Paschall

*Attorney, Agent, or Firm*—Birch, Stewart, Kolasch & Birch

[57] ABSTRACT

In a temperature control system having a heating element and a temperature sensor for sensing the temperature generated by the heating element and providing signals effective to control electric energy to be supplied to the heating element, both the heating element and the temperature sensor are implemented with a single element structure for example a power transistor, which is enabled as a heating element during a first period of time and as a temperature sensor during a second period of time. Thus, the heating/temperature sensing element is enabled on a time-shared basis, compensating for heat resistance incurred during transmission of heat from the heating element to the temperature detecting element. Such a temperature control is useful with precision devices such as an ink jet printer.

2 Claims, 5 Drawing Figures

HIGH-ACCURACY TEMPERATURE CONTROL

This application is a continuation of application Ser. No. 130,998 filed on Mar. 17, 1980, which is a continuation of Ser. No. 893,791, filed Apr. 5, 1975, both now abandoned.

BACKGROUND OF THE INVENTION

The present invention relates to a temperature control capable of always keeping an object at a fixed temperature.

A typical example of a prior art temperature control involves employment of bimetal material whereby a mechanical contact is opened or closed to control the supply of power to a heater. It is also well known to use a temperature sensor such as a thermister or a positive temperature characteristic thermistor to keep an object at a desired temperature.

These prior art temperature controls generally comprise a heating element adapted to heat an object and a temperature sensor (for example, a bimetal and a thermistor) adapted to the supply of power to the heating element. A feed-back loop including the temperature sensor controls the supply of power to the heating element and keeps the object at a given temperature. Nevertheless, it is difficult to accurately maintain the object at the desired temperature because substantial heat resistance is present while heat from the heating element is transmitted to the object. A temperature increase or decrease in the object and even temperature detection will be time-delayed due to the heat capacity of a heat transmission medium and the object, and the heat resistance of the heat transmission medium. This makes a control system unstable and the gain of the control system relatively lower.

SUMMARY OF THE INVENTION

Accordingly, it is an object of the present invention to provide an improved temperature control which maintain an object at a desired temperature while compensating for the heat resistance of a heat transmission medium by temperature-controlling the object via the heating transmission medium.

It is another object of the present invention to provide a temperature control system wherein heating operations and temperature sensing operations are carried out through the utilization of the same construction element.

BRIEF DESCRIPTION OF THE DRAWINGS

Other objects and many of the attendant advantage of the present invention will be readily appreciated as the same becomes better understood by reference to the following detailed description which considered in conjunction with the accompanying drawings in which like reference numerals designate like part throughout the figures thereof, and wherein.

DETAILED DESCRIPTION OF THE INVENTION

Figure 1:
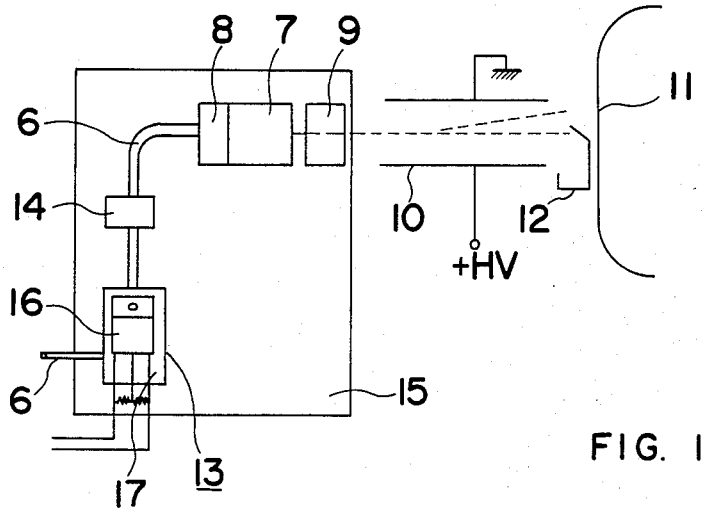
FIG. 1 is a schematic diagram of a temperature control system of the present invention used with an ink jet printer to keep ink at a desired temperature.

Referring now to FIG. 1 of the drawings, there is illustrated a temperature control system embodying the present invention which is applied to an ink jet printer. It is obvious to those skilled in the art that the present invention is equally applicable to other precision devices. In FIG. 1 ink is supplied under pressure via a conduit 6 to a nozzle 7. Ink is excited to form a succession of ink droplets at a desired interval by an ultrasonic vibrator 8 installed about the nozzle 7 as it spouts from the nozzle 7. Those ink droplets are charged according to intelligence signals by a charging electrode 9 and then deflected in proportion to the amplitude of the charge carried on the respective ink droplets as they pass a deflection electrode 10. This results in the formation of a dotted pattern onto a record member 11. The ink droplets which do not contribute to the printing operation are not charged and are directed toward a gutter 12 for recycling purposes after passing the deflection electrode 10. The ink droplets caught by the gutter 12 are recycled back to an ink supply system.

It will be noted that ink is supplied to the nozzle 7 via the temperature control means 13 of the present invention and a mask filter 14.

The above-mentioned ink jet printer is required to maintain continuously at a desired temperature, ink which is sought to be supplied to the nozzle 7. In other words, in the case where ink temperature is not stable, the function of splitting ink into droplets will be largely varied to cause printing distortion. A printing head carrying the nozzle 7 and the charging electrode 9 and so on is mounted on a transversely and reversibly travelling carriage 15. It is, therefore, also preferable that the temperature control means 13 on the carriage 15 be as light as possible.

Pursuant to one preferred form of the present invention, the temperature control means 13 comprises a power transistor 16 and a heat exchanger 17 thermally, tightly coupled with the power transistor 16 to fullfill the weight requirement. The ink conduit 6 is so installed within the interior of the heat 17 as to transmit heat from the power transistor 16 to ink via the heat exchanger 17. According to the present invention the power transistor 16 also functions as a temperature sensor like a thermistor.

Figure 2:
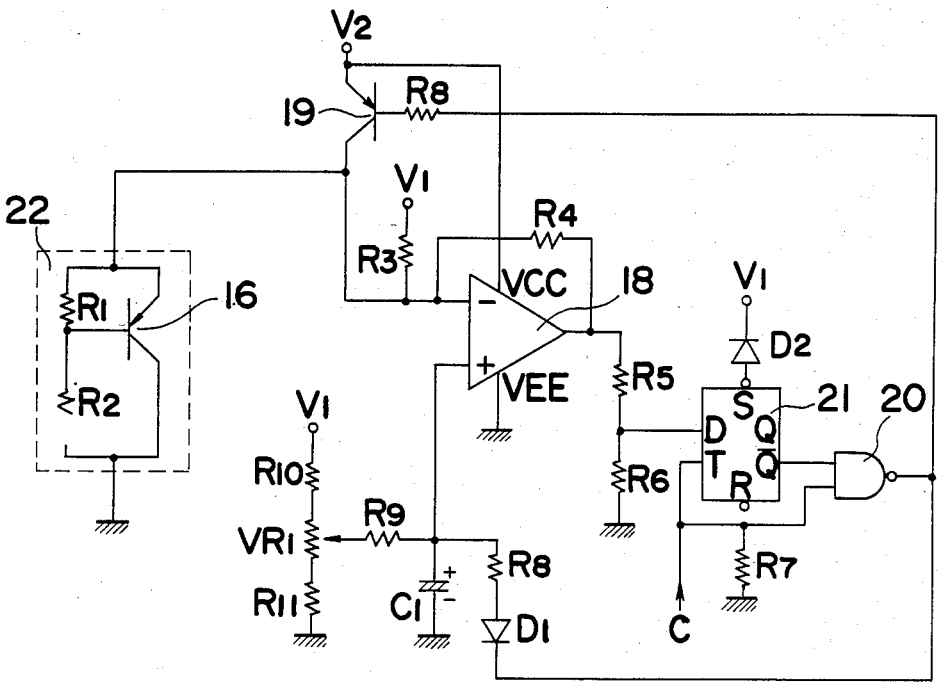
FIG. 2 is a circuit diagram of details of the temperature control circuit of the present invention.

A detailed circuit construction of the temperature control means of the present invention is illustrated in FIG. 2. The transistor 16 briefly described above has a resistor $R_1$ connected in an emitter-to-base path and a second resistor $R_2$ connected in a base-to-collector path. The collector of the transistor 16 is grounded with the emitter supplied via a resistor $R_3$ with a power supply voltage $V_1$ (say, 15 volts). The emitter of the transistor 16 is further connected to the minus input terminal of an operational amplifier 18 of which the plus input terminal is supplied with a given reference voltage for temperature-controlling purposes. This reference voltage is variable through the use of a voltage divider $R_{10}$, $VR_1$, $R_{11}$ and $R_9$ associated with the power supply voltage $V_1$, more specifically with the variable resistor $VR_1$.

A transistor 19 is switched on and off in response to the output of a NAND gate 20, with the emitter thereof connected with a second power supply voltage $V_2$ (Say, 18 volts) and the collector thereof connected with the emitter of the heating/temperature-controlling transistor 16. When the transistor 19 is on, a higher voltage $V_2$ is applied to the transistor 16 such that a large amount of base bias current flows through the transistor 16. This leads to a flow of emitter current which permits the transistor 16 to generate heat.

An input terminal of the NAND gate 20 receives a clock signal C with for example 2.5 KHz, while the other input terminal thereof receives an output from an output terminal $\overline{Q}$ of a D type latch 21. The output of the operational amplifier 18 is applied via a resistor $R_5$ to an input terminal D of the D type latch 21 which is grounded via a resistor $R_6$. A trigger input terminal T of the latch 22 is clocked with the above mentioned clock signal C.

With such an arrangement, the reference voltage (say, nearly 5 volts) is impressed on the plus input terminal of the operational amplifier 18. Assume now that the transistor 19 is in the off state. The emitter of the transistor 16 is held at a potential equal to that of the plus input terminal as a result of the amplification operation of the operational amplifier 18. The resistor $R_3$ is arranged to supply bias current for the temperature sensing scheme consisting of the resistor $R_1$ and $R_2$ and the transistor 16. Generally speaking, the transistor 16 is temperature sensitive and shows the inherent characteristics that the threshold voltage level V is increased with an increase in temperature and decreased with a decrease in temperature.

Figure 4:
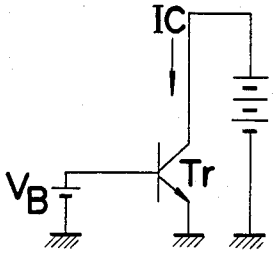
FIGS. 4 and 5 are charts showing principle characteristics temperature sensing circuit.
Figure 5:
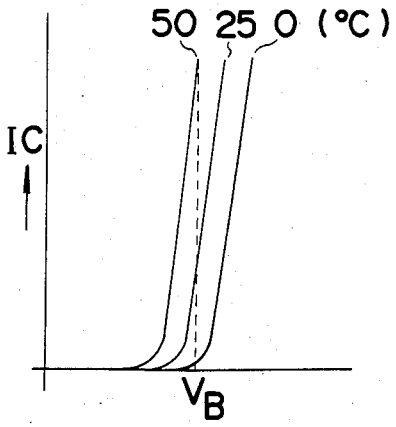

More particularly, FIGS. 4 and 5 illustrate a temperature sensing circuit utilizing the temperature sensitive characteristic of a transistor Tr. In FIG. 4, the collector circuit $I_C$ will be varied correspondingly with a variation in the base voltage $V_B$. In this instance a difference in temperature of the transistor Tr causes a substantial variation in the collector current $I_C$ as viewed from FIG. 5. Therefore, provided that a given voltage $V_B$ is applied between the base and emitter of the transistor Tr, a variation in temperature of the transistor Tr will result in a variation in the collector current $I_C$. When the voltage $V_B$ exceeds the threshold voltage level, the collector current $I_C$ changes abruptly.

Accordingly, with a temperature drop in the transistor 16 of FIG. 2 the threshold voltage level of the transistor 16 is then increased so that the transistor circuit is negative-biased to thereby reduce the emitter current. This means that the temperature sensing operation is through. Though the operation amplifier 18 attempts to increase the input potential of the minus input terminal, that input potential is held at the reference potential of the plus input terminal due to the feed-back loop of the operational amplifier 18 including the resistor $R_4$. At this time the output potential of the operational amplifier 18 is largely reduced. If the clock signal C to the latch 21 and the NAND gate 20 goes up, then the output terminal $\overline{Q}$ of the latch 21 is at a high level to render the NAND gate 20 conductive. The transistor 19 is turned on, which permits the high voltage $V_2$ to be impressed upon the temperature sensing circuit 22. Thus, the transistor 16 is supplied with large current in response to a sufficient flow of the base bias, serving as a source of heat. In response to the transistor 19 in the on state current of about 0.6A flows through the transistor 16 with power consumption of about 10W to generate heat. This heat is used to heat ink via the heat exchanger 17 and keep it at a desired temperature.

The heating operation is carried out in the above manner. Thereafter, when the clock signal C goes down, the transistor 19 is turned off to place the temperature sensing circuit including the transistor 19 into the temperature measuring mode. Conversely, when the clock signal C is increased to a high level, the transistor 19 is turned on such that the transistor 16 within the temperature sensing circuit 22 serves as a heating element which may be used to heat ink in the system of FIG. 1.

If the temperature of the transistor 16 runs above the reference temperature, then the threshold voltage level of the transistor 16 will be decreased due to the temperature characteristics thereof. The transistor 16 is forward-biased. This allows the emitter current to flow through the transistor 16 and urges the input potential of the minus input terminal of the operational amplifier 18 to increase. This implies that the output potential is raised so as to keep the input potential constant by the action of the operational amplifier 18. As a result, the input terminal D of the latch 21 is at a high level "H". Upon the leading edge of the next incoming clock signal C the output terminal $\overline{Q}$ drops to a lower level "L". For this reason the transistor 19 can neither turn on nor supply the temperature sensing circuit 22 with a voltage necessary for the heating operation. Thus, the heating operation is not enabled. While the temperature sensing circuit 22 is operated during the heating mode, the heating operation is no longer required because the transistor 16 is already at the reference temperature or more.

Figure 3:
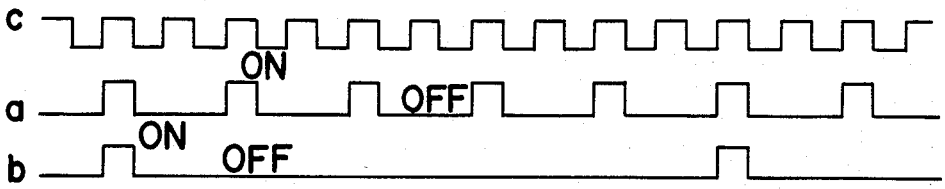
FIG. 3 is a time diagram showing operation of the temperature control circuit of FIG. 2.

FIG. 3 shows a time diagram showing the on and off states of the transistor 16 under the low temperature condition (a) and the high temperature condition (b). Needless to say, the heating operation is repeated more times under the low temperature condition (a) and less times under the high temperature condition (b).

In this way, ink is accurately temperature-controlled by the temperature control 13 of FIG. 1 resulting in a constant temperature. What is in fact necessary to be held at a desired fixed temperature is just a portion of the nozzle 7. The temperature of this portion of the nozzle 7 is influenced and cooled by the surrounding atmosphere via the mask filter 14, the conduit 6 and the nozzle 7. As a matter of fact, the ink temperature could not reach exactly the reference temperature due to heat resistance present between the heating transistor 16 and a transistor housing and the heat exchanger 12. This provides a severe problem with a small size power transistor used as a source of heat. Provided that the temperature control 13 is mounted on the travelling carriage 15 as in the given example, the temperature control itself must be compact and the above discussed problem can be minimized.

One way of overcoming the above problem and making the ink temperature of the nozzle portion constant involves increasing the reference temperature. As shown in FIG. 2, this is accomplished by applying a signal from the feedback loop including the diode $D_1$, the resistor $R_8$ and the capacitor $C_1$ to the plus input terminal of the operational amplifier 18. In other words, this causes a substantial reduction in the reference voltage and hence a substantial increase in the reference temperature of the transistor 16.

In the circuit of FIG. 2 the amplification function of the operational amplifier 18 serves to equalize the potential of the minus input terminal with the reference voltage of the plus input terminal. Thus, the transistor 19 is turned on. In the case where the output of the NAND gate 20 is reduced to at a low level "L" many times, ink being supplied remains cool and the ink temperature at the nozzle portion 7 is reduced due to heat resistance and other factors. Therefore, the reference temperature of the transistor 16 is required to raise in order to rise the ink temperature of the nozzle portion 7 and keep it constant. To this end, the above-mentioned feed-back circuit functions to reduce the voltage to be supplied to the plus input terminal of the operational amplifier 18, eventually increasing the reference temperature of the transistor 16. In this way, the feed-back path compensates for a temperature drop caused by heat resistance and other factors and keeps the ink temperature of the nozzle portion 7 at a fixed temperature.

As noted earlier, the temperature control of the present invention employs same element serving alternatively as the heat generating element and the temperature sensing element. This gives rise to small size implementations and improvements in response.

While a certain representative embodiment and details have been shown for the purpose of illustrating the invention, it will be apparent to those skilled in this art that various changes and modifications may be made without departing from the spirit or scope of the invention, and all such modifications as would be obvious to one skilled in the art are intended to be included within the scope of the following claims.

What is claimed is:

1. A temperature control means for accurately controlling the temperature of the ink supply in an ink jet printer comprising:

a single power transistor having a base, emitter and collector for generating heat in a heating mode and sensing temperature in a sensing mode, said power transistor producing a temperature related output voltage at its emitter when in said sensing mode and having its collector grounded;

a first resistor interconnecting the emitter and base of said single power transistor;

a second resistor interconnecting the collector and base of said single power transistor;

sensing means, connected to said single power transistor, for monitoring the temperature related output voltage of said single power transistor when in the sensing mode;

a power voltage source developing a heating voltage for application to said single power transistor when in a heating mode;

a switching transistor having a base, emitter and collector, said switching transistor having its emitter connected to said voltage source and its collector connected to said single power transistor, said switching transistor being turned on only when a power application pulse is applied to its base in the heating mode to apply said heating voltage to said single power transistor, said temperature control means being in said sensing mode when said power control signal is not developed;

a sensing voltage source developing a reference voltage representative of the desired temperature of said single power transistor;

a differential amplifier comparator having a first input terminal connected to said single power transistor to receive said temperature related output voltage and having a second input terminal connected to said sensing voltage source to receive said reference voltage, said comparator comparing said temperature related output voltage to said reference voltage and developing a power application signal when said sensed temperature of said single power transistor is less than the desired temperature represented by said reference voltage;

a clock signal generator generating a clock pulse train;

a bistable latch circuit having a toggle input to which said clock pulse train is introduced and having an information input to which said power application signal is introduced, said bistable latch circuit developing a power application pulse at its output when said power application signal is applied to said bistable latch circuit and said clock pulse train produces a clock pulse, said power application pulses being produced only during production of alternate clock pulses by said clock signal generator when said power application signal is present, said power application pulse placing said temperature control means in a heating mode;

a feedback compensation path including a serially connected third resistor and diode having an anode and cathode, the cathode of said diode being connected to the output of said bistable latch circuit, the anode of said diode being connected to said resistor which in turn is connected to said second input terminal of said comparator; and heat exchanger means for transferring heat from said power transistor means to said ink supply;

said power application pulses being of fixed duration and variable frequency to thereby produce a pulse frequency modulated train of said power application pulse.

2. The temperature control means of claim 1 wherein said bistable latch circuit includes a bistable latch having said toggle and information inputs and at least an inverted output; and a NAND gate having a first input connected to said inverted output of said bistable latch and a second input connected to said clock signal generator and developing said power application pulse at its output.

* * * * *